US010092940B2

(12) United States Patent
Kawai et al.

(10) Patent No.: US 10,092,940 B2
(45) Date of Patent: Oct. 9, 2018

(54) METHOD FOR FORMING A PRESSED COMPONENT, METHOD FOR MANUFACTURING A PRESSED COMPONENT, AND DIE APPARATUS FOR FORMING A PRESSED COMPONENT

(71) Applicant: Kabushiki Kaisha F.C.C., Hamamatsu-shi, Shizuoka (JP)

(72) Inventors: Keitaro Kawai, Hamamatsu (JP); Yuki Shimizu, Hamamatsu (JP)

(73) Assignee: Kabushiki Kaisha F.C.C., Hamamatsu-shi (JP)

( * ) Notice: Subject to any disclaimer, the term of this patent is extended or adjusted under 35 U.S.C. 154(b) by 746 days.

(21) Appl. No.: 14/759,162

(22) PCT Filed: Dec. 19, 2013

(86) PCT No.: PCT/JP2013/084109
§ 371 (c)(1),
(2) Date: Jul. 2, 2015

(87) PCT Pub. No.: WO2014/109202
PCT Pub. Date: Jul. 17, 2014

(65) Prior Publication Data

US 2015/0336155 A1 Nov. 26, 2015

(30) Foreign Application Priority Data

Jan. 11, 2013 (JP) ..... 2013-004113

(51) Int. Cl.
*B21D 28/28* (2006.01)
*B21D 28/24* (2006.01)
(Continued)

(52) U.S. Cl.
CPC ..... *B21D 28/243* (2013.01); *B21D 19/08* (2013.01); *B21D 19/088* (2013.01); *B21D 28/14* (2013.01);
(Continued)

(58) Field of Classification Search
CPC .... B21D 28/243; B21D 19/08; B21D 19/088; B21D 28/14; B21D 28/26; B21D 28/34; B21D 5/10
(Continued)

(56) References Cited

U.S. PATENT DOCUMENTS 1,007,942 A * 11/1911 Hansen ..... B21K 1/30 29/894.01
4,245,491 A * 1/1981 Kondo ..... B21D 22/04 72/254
(Continued)

FOREIGN PATENT DOCUMENTS

JP 52128638 9/1977
JP 09164431 6/1997
(Continued)

*Primary Examiner* — David B Jones
(74) *Attorney, Agent, or Firm* — Michael Tobias

(57) ABSTRACT

A piercing die, a holding body, and a piercing punch are used to form a pressed component having a plate-shaped base portion and a tubular boss portion extending from the base portion. The piercing die has a receiving portion, an outer shape-forming portion, and a die-side cutting edge. The piercing punch has an inner shape-forming portion, a punch-side cutting edge, and a straight portion. In a process of forming a pressed component, the piercing punch is pressed against a preform which is formed from a blank and which has a preliminary boss portion so as to cause part of the preliminary boss portion to flow toward the outer shape-forming portion, and so as to then cut off another part of the preliminary boss portion to form a boss portion.

3 Claims, 5 Drawing Sheets

(51) Int. Cl.

| | |
|---|---|
| ***B21D 19/08*** | (2006.01) |
| ***B21D 28/14*** | (2006.01) |
| ***B21J 5/10*** | (2006.01) |
| ***B21D 28/26*** | (2006.01) |
| ***B21D 28/34*** | (2006.01) |

(52) U.S. Cl.
CPC ..... *B21D 28/26* (2013.01); *B21D 28/34* (2013.01); *B21J 5/10* (2013.01)

(58) Field of Classification Search
USPC ..... 72/327
See application file for complete search history.

(56) References Cited

U.S. PATENT DOCUMENTS

| | | | | |
|---|---|---|---|---|
| 4,939,829 | A * | 7/1990 | Maki | B21K 1/30 29/893.34 |
| 6,053,023 | A * | 4/2000 | Landrum | B21J 5/02 72/355.4 |
| 6,152,005 | A | 11/2000 | Ootsuka | 83/138 |
| 7,013,550 | B2 * | 3/2006 | Shinjo | B21K 1/702 29/432.2 |
| 7,314,417 | B2 * | 1/2008 | Babej | B21D 53/24 470/109 |
| 9,968,979 | B2 * | 5/2018 | Shimizu | B21D 35/001 |
| 2015/0352622 | A1 | 12/2015 | Shimizu et al. | |

FOREIGN PATENT DOCUMENTS

| | | |
|---|---|---|
| JP | 10094837 | 4/1998 |
| JP | 2004223583 | 8/2004 |
| JP | 2010260078 | 11/2010 |

* cited by examiner (A)

(B)

METHOD FOR FORMING A PRESSED COMPONENT, METHOD FOR MANUFACTURING A PRESSED COMPONENT, AND DIE APPARATUS FOR FORMING A PRESSED COMPONENT

TECHNICAL FIELD

The present invention relates to a method for forming a pressed metal component having a plate-shaped base portion and a tubular boss portion extending from the base portion, a method for manufacturing such a pressed component, and a die apparatus for forming such a pressed component.

BACKGROUND ART

In the assembly of what are referred to as machine parts for machinery, a pressed metal component having a plate-shaped base portion and a tubular boss portion extending from the base portion has conventionally been used. A pressed component is generally formed by drawing, stretch flanging, blanking, and cutting.

For example, below-described Patent Document 1 discloses a method for forming a pressed component which includes forming a tubular preform portion on a plate-shaped blank such that the preform portion protrudes from the blank and has a closed central portion, and removing the closed central portion of the preform portion by piercing to form a tubular boss portion.

PRIOR ART DOCUMENTS

Patent Documents

Patent Document 1: JP 2010-260078 A

However, in the method for forming a pressed component described in Patent Document 1, a preform portion is formed on a plate-shaped blank such that the preform portion has a shape close to the final shape of the boss portion. Therefore, the thicker the blank, the greater the compressive load required to form the preform portion. Accordingly, the conventional method involves the problem that equipment including a die apparatus becomes large and complex. In particular, in the case of forming a female thread on the inner circumference of the boss portion of the pressed component by tapping, the problem arises that the greater the degree to which the wall thickness of the boss portion is increased so as to increase the rigidity of the female thread, the greater the difficulty in forming the boss portion by a press.

The above-described conventional method for forming a pressed component has another problem that many restrictions are imposed on the shape of the boss portion of the pressed component. Specifically, in the conventional method for forming a pressed component, the entirety of the closed portion of the preform portion becomes scrap as a result of formation of a rough hole by piercing, and material is not used efficiently. Therefore, the boss portion can not have a large amount of projection and a large wall thickness. In addition, in a piercing process to form a through-hole in a material, it is generally impossible to form a through-hole having a diameter smaller than the thickness of the plate material. Thus, the conventional method for forming a pressed component has the problem that the inner diameter of the boss portion is restricted to one greater than the thickness of the blank.

The present invention was made in order to cope with the above-described problems, and its object is to provide a method for forming a pressed metal component, a method for manufacturing such a pressed component, and a die apparatus for forming such a pressed component which decrease the size and the degree of complexity of equipment used for forming a pressed metal component having a plate-shaped base portion and a tubular boss portion extending from the base portion and allow formation of the boss portion in a wide variety of shapes.

SUMMARY OF THE INVENTION

In order to achieve the above object, the present invention provides a method for forming a pressed metal component having a plate-shaped base portion and a tubular boss portion extending from the base portion. The method is characterized by comprising a step of preparing a piercing die having a cylindrical outer shape-forming portion having a shape corresponding to an outer shape of the boss portion of the pressed component, and a die-side cutting edge located at a position radially inward from the outer shape-forming portion by an amount corresponding to a thickness of the boss portion; a step of preparing a piercing punch having a rod-shaped body, a bomb-shaped inner shape-forming portion formed at an end of the rod-shaped body, and a punch-side cutting edge located at a position radially outward from the inner shape-forming portion so as to cooperate with the die-side cutting edge; a preliminary boss portion-forming step of pressing a plate-shaped blank using a punch with a bomb-shaped end so as to cause part of the blank to project to thereby form a preliminary boss portion; a rough hole-forming step of forming a through-hole, as a rough hole, in a projecting end portion of the preliminary boss portion; and a boss portion-forming step of placing the piercing die so as to face an outer periphery of the preliminary boss portion and the piercing punch so as to face an inner periphery of the preliminary boss portion, and moving the piercing die and the piercing punch relative to each other so as to cause the inner shape-forming portion to pierce the preliminary boss portion to thereby force part of the preliminary boss portion to flow toward the outer shape-forming portion and then cut off another part of the preliminary boss portion by using the die-side cutting edge and the punch-side cutting edge.

According to the feature of the present invention, a pressed component is formed as follows. A convex preliminary boss portion is formed on a blank which is the material of the pressed component, and a rough hole is formed in a projecting end portion of the preliminary boss portion. Subsequently, the inner shape-forming portion of the piercing punch is caused to pierce the preliminary boss portion having the rough hole so as to cause part of the preliminary boss portion to flow toward the outer shape-forming portion of the piercing die, and then another part of the preliminary boss portion is cut off using the die-side cutting edge and the punch-side cutting edge. Namely, in the pressed component-forming method of the present invention, when a boss portion is formed on the blank, a convex preliminary boss portion is formed, and a rough hole is formed in the projecting end portion of the preliminary boss portion. Thus, according to the pressed component-forming method of the present invention, after a convex preliminary boss portion which is a simple shape is formed on the blank and a rough hole is formed in the projecting end portion of the preliminary boss portion, a boss portion is formed by using the piercing punch and the piercing die. Therefore, the compressive load required in each step can be reduced. In addition, since the projecting end portion of the preliminary boss portion can be formed to have a small wall thickness, it becomes easy to form a rough hole having a diameter smaller than the thickness of the blank, and the volume of a part cut off by using the piercing punch and the piercing die can be minimized. As a result, according to the pressed component forming method of the present invention, equipment used for forming the pressed component can be made small and simple, and it becomes possible to form a boss portion with any of a wide variety of shapes, and more specifically with a greater amount of projection and wall thickness than the prior art.

A second feature of the present invention is that in the preliminary boss portion-forming step, the projecting end portion of the preliminary boss portion is formed so as to have a thickness of less than or equal to one tenth the thickness of the blank.

According to the second feature of the present invention, in the preliminary boss portion-forming step, the projecting end portion of the preliminary boss portion is formed so as to have a thickness of less than or equal to one tenth the thickness of the blank. Therefore, a rough hole having a diameter smaller than the thickness of the plate member can be easily formed in the rough hole-forming step.

The present invention can be implemented not only as a method for forming a pressed metal component but also as a method for manufacturing a pressed metal component and a die apparatus for forming a pressed metal component.

Specifically, the method for manufacturing a pressed metal component is a method for manufacturing a pressed metal component having a plate-shaped base portion and a tubular boss portion extending from the base portion. Preferably, the manufacturing method comprises a step of preparing a piercing die having a cylindrical outer shape-forming portion having a shape corresponding to an outer shape of the boss portion of the pressed component, and a die-side cutting edge located at a position radially inward from the outer shape-forming portion by an amount corresponding to a thickness of the boss portion; a step of preparing a piercing punch having a rod-shaped body, a bomb-shaped inner shape-forming portion formed at an end of the rod-shaped body, and a punch-side cutting edge located at a position radially outward from the inner shape-forming portion so as to cooperate with the die-side cutting edge; a preliminary boss portion-forming step of pressing a plate-shaped blank using a punch with a bomb-shaped end so as to cause part of the blank to project to thereby form a preliminary boss portion; a rough hole-forming step of forming a through-hole, as a rough hole, in a projecting end portion of the preliminary boss portion; and a boss portion-forming step of placing the piercing die so as to face an outer periphery of the preliminary boss portion and the piercing punch so as to face an inner periphery of the preliminary boss portion, and moving the piercing die and the piercing punch relative to each other so as to cause the inner shape-forming portion to pierce the preliminary boss portion to thereby force part of the preliminary boss portion to flow toward the outer shape-forming portion and then cut off another part of the preliminary boss portion by using the die-side cutting edge and the punch-side cutting edge.

The die apparatus for forming a pressed metal component is a die apparatus for forming a pressed metal component having a plate-shaped base portion and a tubular boss portion extending from the base portion. Preferably, the die apparatus comprises a piercing die having a cylindrical outer shape-forming portion having a shape corresponding to an outer shape of the boss portion of the pressed component, and a die-side cutting edge located at a position radially inward from the outer shape-forming portion by an amount corresponding to a thickness of the boss portion; and a piercing punch having a rod-shaped body, a bomb-shaped inner shape-forming portion formed at an end of the rod-shaped body, and a punch-side cutting edge located at a position radially outward from the inner shape-forming portion so as to cooperate with the die-side cutting edge.

BRIEF DESCRIPTION OF THE DRAWINGS

FIGS. 1(A) and 1(B) schematically illustrate the structure of a pressed component formed by a method for forming a pressed component (hereinafter referred to as a "pressed component-forming method") according to one embodiment of the present invention, wherein FIG. 1(A) is a plan view of the pressed component, and FIG. 1(B) is a cross-sectional view of the pressed component taken along line A-A in FIG. 1(A).

MODES FOR CARRYING OUT THE INVENTION

Figure 1:
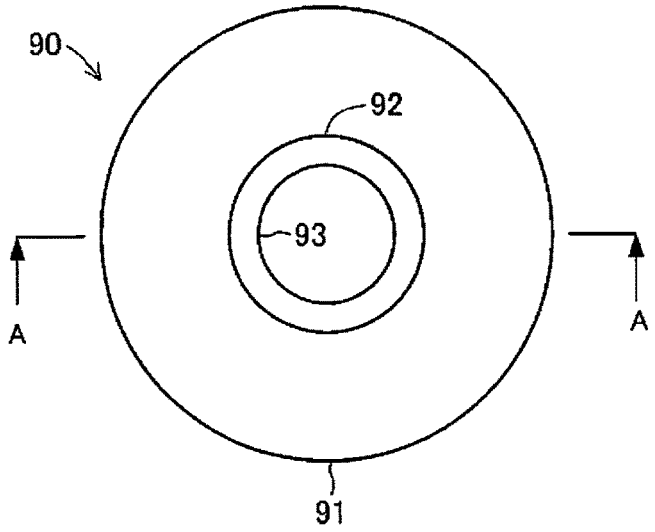
Figure 1:
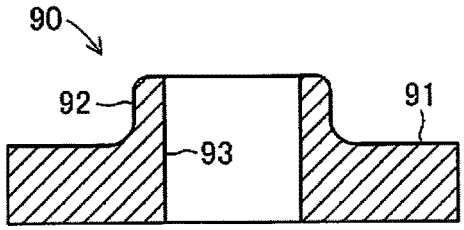
Figure 2:
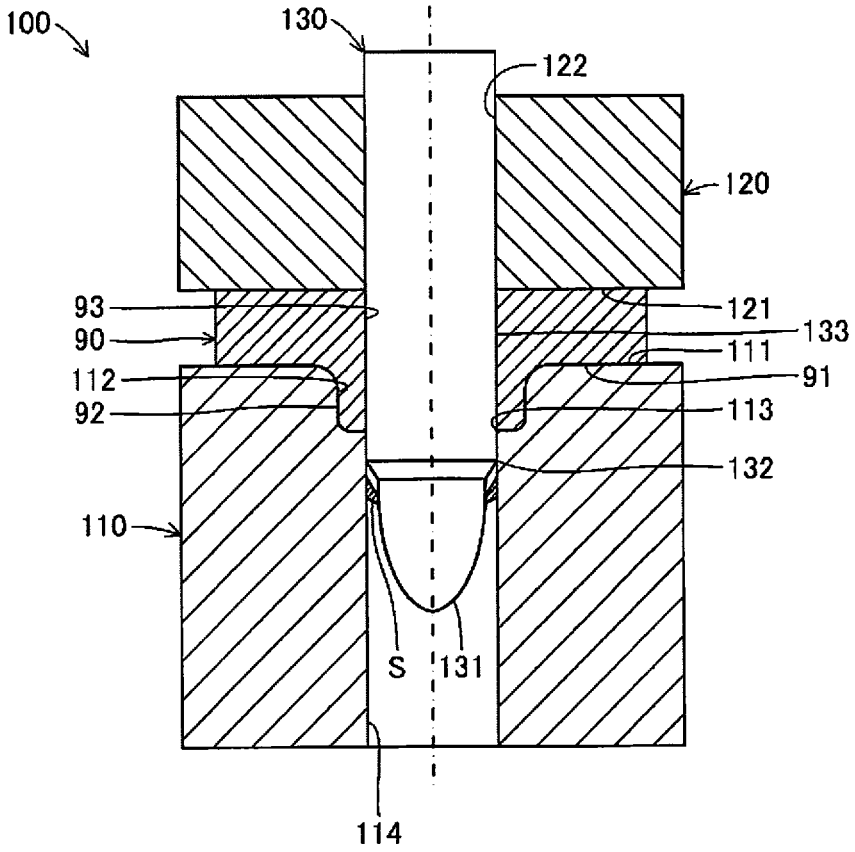
FIG. 2 is a cross-sectional view showing a forming die apparatus used in the pressed component-forming method according to the embodiment of the present invention, and a process of manufacturing a pressed component using the forming die apparatus.

A pressed component-forming method according to one embodiment of the present invention will be described below with reference to the drawings. FIGS. 1(A) and 1(B) schematically illustrate the structure of a pressed component 90 formed by a pressed component-forming method of the present invention. FIG. 1(A) is a plan view of the pressed component 90, and FIG. 1(B) is a cross-sectional view of the pressed component 90 taken along line A-A in FIG. 1(A). FIG. 2 is a cross-sectional view schematically showing how the pressed component 90 is formed by the pressed component-forming method of the present invention. The figures referred to in the description are schematically illustrated with some components exaggerated in order to facilitate an understanding of the present invention. Therefore, components shown in the drawings may have dimensions, proportions, etc. which are different from the actual ones.

The pressed component 90 formed by a pressed component-forming method according to the present invention will be briefly described. The pressed component 90 is a component used in the assembly of what are referred to as machine parts for machinery and is formed by pressing a plate of steel such as carbon steel (e.g., SPCC, SPCD, SPCE, or S35C) or high-tensile steel. The pressed component 90 has a plate-shaped base portion 91 and a tubular boss portion 92 projecting from the base portion 91. The pressed component 90 has a through-hole 93 extending through the base portion 91 and the boss portion 92. This through-hole 93 in the pressed component 90 can be used for a rough hole for tapping, a hole for crimping, or a hole for mounting a machine part such as a bearing.

(Structure of Forming Die Apparatus 100)

A forming die apparatus 100 for forming the pressed component 90 using a pressed component-forming method according to the present invention will be described. The forming die apparatus 100 is mainly composed of a piercing die 110, a holding body 120, and a piercing punch 130.

The piercing die 110 is a die which is formed of die steel so as to have a substantially hollow cylindrical shape. The piercing die 110 cooperates with the holding body 120 to hold and support a preform 90' which is a semi-processed product which becomes the pressed component 90. In addition, the piercing die 110 cooperates with the piercing punch 130 to press and cut the preform 90', thereby forming the pressed component 90. More specifically, the piercing die 110 generally includes a receiving portion 111, an outer shape-forming portion 112, and a die-side cutting edge 113.

The receiving portion 111 cooperates with the holding body 120 to hold and support the base portion 91 of the preform 90' between them. The receiving portion 111 is formed at the end surface of the cylindrical piercing die 110 facing the holding body 120 (the upper surface in the figure) and has a planar annular shape. The outer shape-forming portion 112 is formed radially inward of the receiving portion 111 such that the outer shape-forming portion 112 is continuous with the receiving portion 111.

The outer shape-forming portion 112 is a portion for forming the outer periphery of the boss portion 92 of the pressed component 90. The outer shape-forming portion 112 has a shape corresponding to that of the outer periphery of the boss portion 92, namely, a concave shape which is the reverse of the shape of the outer periphery of the boss portion 92. The outer shape-forming portion 112 has an annular bottom portion for forming an annular end surface of the boss portion 92. The bottom portion extends radially inward of the outer shape-forming portion 112 and has a width corresponding to the wall thickness of the boss portion 92. The die-side cutting edge 113 is formed along the inner circumferential edge of the annular bottom portion.

The die-side cutting edge 113 is an annular blade which cooperates with the piercing punch 130 to perform a process of cutting off a part of a below-described preliminary boss portion 92' of the preform 90'. The die-side cutting edge 113 is provided at the boundary between the outer shape-forming portion 112 and a guide hole 114 which extends through the piercing die 110. The guide hole 114, which defines the die-side cutting edge 113 in cooperation with the outer shape-forming portion 112, is a hole for guiding the piercing punch 130 and is formed so as to have an inner diameter which allows the piercing punch 130 to slidably move in the guide hole.

The holding body 120 is a die which cooperates with the piercing die 110 to hold and support the preform 90' and is formed of die steel in a substantially hollow cylindrical shape. More specifically, the holding body 120 generally includes a pressing portion 121 and a guide hole 122. The pressing portion 121 cooperates with the receiving portion 111 of the piercing die 110 to hold and support the base portion 91 of the preform 90' between them. The pressing portion 121 is formed at the end surface of the holding body 120 facing the cylindrical piercing die 110 (the lower surface in the figure) and has a planar ring shape. The guide hole 122 is a hole for guiding the piercing punch 130 and is formed so as to have an inner diameter which allows the piercing punch 130 to slidably move in the guide hole.

The piercing punch 130 is a rod-shaped die which is formed of die steel with a substantially circular columnar shape. The piercing punch 130 cooperates with the piercing die 110 to press and cut the preform 90', thereby forming the pressed component 90. More specifically, the piercing punch 130 generally includes an inner shape-forming portion 131, a punch-side cutting edge 132, and a straight portion 133.

The inner shape-forming portion 131 is provided to press and expand the preliminary boss portion 92' of the preform 90' from the inner side thereof so as to cause part of the preliminary boss portion to flow toward the outer shape-forming portion 112, thereby forming the inner peripheries of the base portion 91 and the boss portion 92 of the pressed component 90, that is, thereby forming the through-hole 93. The inner shape-forming portion is formed with a bomb-shaped tip with its outer diameter increasing from the tip so as to form a parabolic cross section, and a tapered portion extending from the end of the bomb-shaped tip toward the straight portion 133 with its outer diameter increasing toward the straight portion 133. The largest outer diameter of the inner shape-forming portion 131 corresponds to the diameter of the through-hole 93 of the pressed component 90. A punch-side cutting edge 132 is formed at the boundary between the inner shape-forming portion 131 and the straight portion 133.

The punch-side cutting edge 132 is an annular blade which cooperates with the piercing die 110 to perform a process of cutting off a part of the preliminary boss portion 92' of the preform 90. The straight portion 133 is formed so as to have a round bar shape and so as to constitute the punch-side cutting edge 132, and it is used to form the wall of the through-hole 93 of the pressed component 90 while supporting the inner shape-forming portion 131. The outer diameter of the straight portion 133 corresponds to the diameter of the through-hole 93 of the pressed component 90.

In use, the piercing die 110, the holding body 120, and the piercing punch 130, which constitute the forming die apparatus 100, are mounted on a press (not shown) for pressing the preform 90' to form the pressed component 90. The piercing die 110 is secured to the press. The holding body 120 and the piercing punch 130 are provided within the press in coaxial relationship with the piercing die 110 such that they can move toward or away from the piercing die 110.

(Formation of Pressed Component 90)

Figure 3:
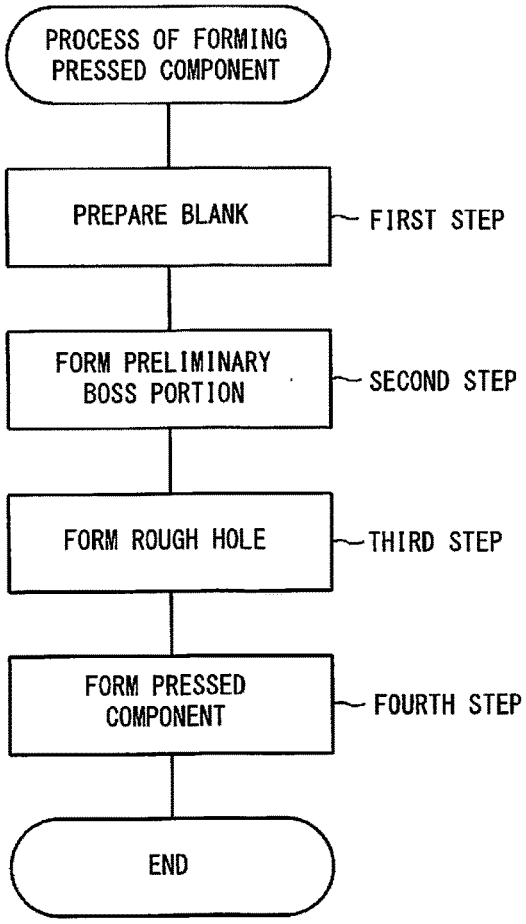
FIG. 3 is a flowchart showing the steps of a process of forming a pressed component by the pressed component-forming method according to the embodiment of the present invention.

Next, the operation of performing a pressed component-forming method by using the forming die apparatus 100 will be described with reference to a process flowchart shown in FIG. 3. FIG. 3 is a flowchart showing the steps of a process of forming the pressed component 90.

Figure 4:
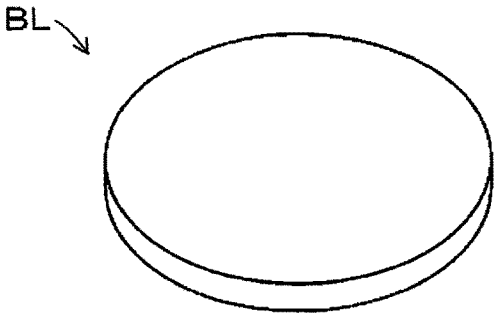
FIG. 4 is a perspective view schematically illustrating the appearance of a blank which is the raw material of a preform used in the pressed component-forming method according to the embodiment of the present invention.

In a first step, an operator prepares the blank BL. Specifically, the operator prepares a plate-shaped blank BL obtained by forming a plate of steel such as carbon steel (e.g., SPCC, SPCD, SPCE, or S35C) or high-tensile steel into a circular shape as shown in FIG. 4.

Figure 5:
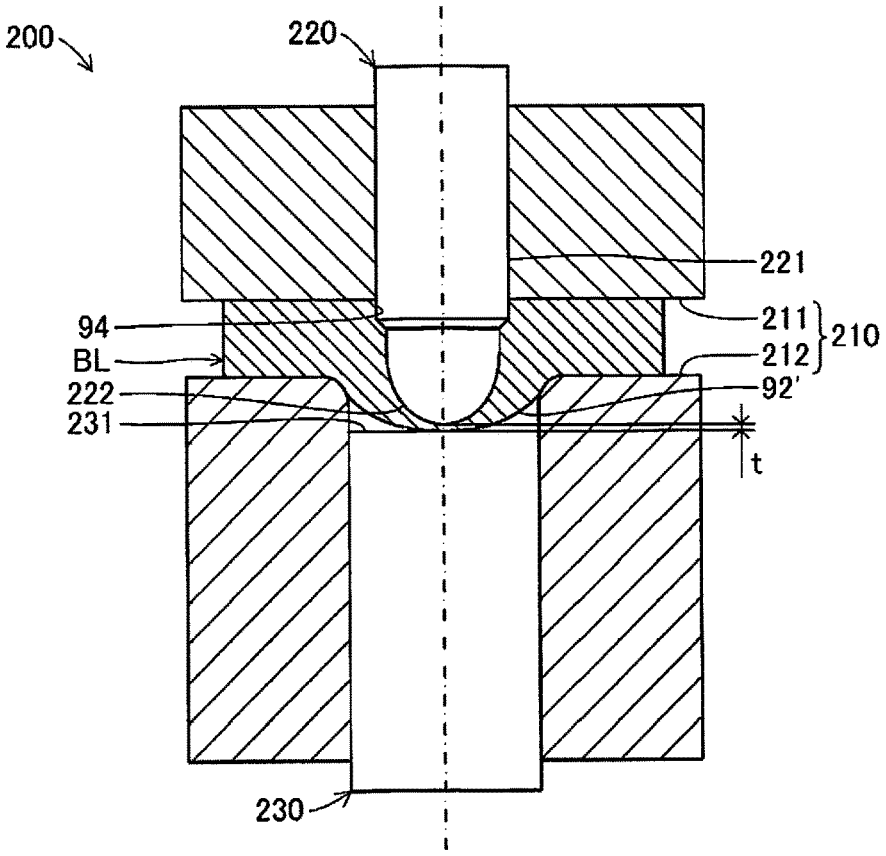
FIG. 5 is a cross-sectional view showing a die apparatus for preliminary forming which is used to form a preliminary boss portion on the blank used in forming the pressed component according to the embodiment of the present invention, and also showing a process of forming the preliminary boss portion by the die apparatus for preliminary forming.

Next, in a second step, the operator forms the preliminary boss portion 92' on the blank BL. As shown in FIG. 5, the preliminary boss portion 92' is a projection formed on the blank BL with a substantially spherical outer shape and a bomb-shaped recess or inner space. A step of forming the preliminary boss portion 92' is performed using a drawing machine (not shown) which is provided with a die apparatus for preliminary forming 200 as shown in FIG. 5.

The die apparatus for preliminary forming 200 is a die apparatus for forming the preliminary boss portion 92' on the blank BL by plastically forming the plate-shaped blank BL. The die apparatus for preliminary forming 200 is mainly composed of a workpiece chuck 210, a punch 220, and an ejector 230. The workpiece chuck 210 is comprised of two dies, i.e., a movable die 211 and a stationary die 212 which are configured to hold and support a peripheral edge portion of the blank BL between them, each being formed of die steel in a substantially hollow cylindrical shape.

The punch 220 is a movable die which is formed of die steel with a substantially circular columnar shape. The punch 220 presses a center portion of the blank BL to form an inner shape of the preliminary boss portion 92'. More specifically, the punch 220 includes a circular columnar portion 221, a bomb-shaped portion 222 provided at one end of the columnar portion 221, and a tapered portion located between the columnar portion and the bomb-shaped portion. The ejector 230 is a movable die which is formed of die steel with a substantially circular columnar shape. The ejector 230 receives the portion of the blank BL which is pressed by the punch 220 to form a part of the outer shape of the preliminary boss portion 92' and pushes a portion of the preliminary boss portion 92' which fits in the hole of the stationary die 212 so that the portion of the preliminary boss portion 92' is ejected from the hole. The ejector 230 has a flat receiving portion 231 for receiving the blank BL.

Therefore, the operator sets the blank BL in the die apparatus for preliminary forming 200 and operates the drawing machine provided with the die apparatus for preliminary forming 200 to start an operation for forming the preliminary boss portion 92'. In response to the operator's instruction, the drawing machine brings the punch 220 and the ejector 230 into close proximity to a center portion of the blank BL fixedly held by the workpiece chuck 210 and presses the punch 220 against the blank BL so that the punch 220 intrudes into or pierces the blank BL. The operator operates the drawing machine to adjust the distance between the punch 220 and the ejector 230 such that the wall thickness t of the projecting end portion of the preliminary boss portion 92' becomes equal to or less than the thickness of the blank BL. Preferably, the thickness t of the projecting end portion of the preliminary boss portion 92' is equal to or less than one tenth the thickness of the blank BL.

In the present embodiment, the thickness t of the blank BL is 4 mm, and the thickness of the projecting end portion of the preliminary boss portion 92' is set to 0.3 mm. In the present embodiment, the operator operates the machine so that a part of the columnar portion 221 of the punch 220, which part is located adjacent to the bomb-shaped portion 222, pierces the blank BL. As a result of pressing by the punch 220, the preliminary boss portion 92' having a spherical outer shape and an inner shape corresponding to the tip of the punch 220 is formed on the blank BL. In the present embodiment, not only the bomb-shaped portion 222 but also a part of the columnar portion 221 form the inner shape of the preliminary boss portion 92' such that a cylindrical portion 94 is formed in a region where the preliminary boss portion 92' starts to rise or protrude. The cylindrical portion 94 is used as a positioning hole in subsequent third and fourth steps. If another positioning method is adopted in which the cylindrical portion 94 is not used, the cylindrical portion 94 may be omitted. In such a case, the punch 220 may be forced into the blank to such an amount that only the bomb-shaped portion 222 is forced to pierce the blank BL.

After forming the preliminary boss portion 92' on the blank BL, the drawing machine opens the workpiece chuck 210 so that the operator can remove the blank BL having the preliminary boss portion 92' from the die apparatus for preliminary forming 200.

Figure 6:
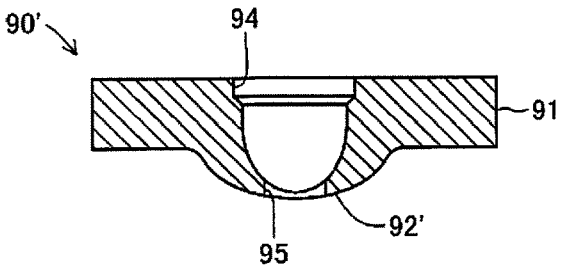
FIG. 6 is a cross-sectional view showing the structure of a preform obtained by forming a rough hole in the preliminary boss portion shown in FIG. 5.

In the third step, the operator forms a rough hole 95 in the preliminary boss portion 92'. As shown in FIG. 6, the rough hole 95 is a through-hole for achieving good plastic deformation of the material when stretch flanging is performed on the preliminary boss portion 92' so as to form the boss portion 92. The formation of the rough hole 95 is carried out using a publicly known hole-forming technique (also called piercing or punching), and accordingly will not be described in detail. In the present embodiment, the thickness t of the blank BL is 4 mm, and the rough hole is formed so as to have a diameter of 3.4 mm.

As a result of the second step in which the preliminary boss portion 92' is formed and the third step in which the rough hole 95 is formed, the blank BL is processed so as to have the preliminary boss portion 92' with the rough hole 95 to form the preform 90'. This means that the second step in which the preliminary boss portion 92' is formed and the third step in which the rough hole 95 is formed correspond to the preliminary boss portion-forming step and the rough hole-forming step in the present invention, respectively.

Next, in the fourth step, the operator forms the pressed component 90. Specifically, as shown in FIG. 2, the operator places the preform 90' formed by the second and third steps in the forming die apparatus 100 and then operates an unillustrated press to start pressing the preform 90'. The operator places the preform 90' such that the preliminary boss portion 92' of the preform 90' is located in the outer shape-forming portion 112 of the piercing die 110. In the process of forming the pressed component 90, as shown in FIG. 2, the press causes the holding body 120 to move toward the piercing die 110 so that the piercing die 110 and the holding body 120 hold and support the base portion 91 of the preform 90' between them, wherein the base portion 91 is a portion of the preform 90' located radially outward of the preliminary boss portion 92'. More specifically, the pressed component 90 is formed by the following sub-steps 1 and 2 after movement of the piercing punch 130 toward the piercing die 110 is started.

Sub-step 1: The preliminary boss portion 92' of the preform 90' is formed into the boss portion 92 by stretch flanging. Specifically, after the inner shape-forming portion 131 of the piercing punch 130 has entered the inner space of the preliminary boss portion 92' as a result of the movement of the piercing punch 130 toward the piercing die 110, the inner shape-forming portion 131 presses the inner surface of the preliminary boss portion 92' outward. As a result, the rough hole 95 is expanded, and part of the preliminary boss portion 92' flows toward the outer shape-forming portion 112 of the piercing die 110 so that the preliminary boss portion 92' is formed into a shape corresponding to the outer shape-forming portion 112.

Sub-step 2: Next, part of the preliminary boss portion 92' of the preform 90' is cut off. Specifically, after the piercing punch 130 advances to break through the projecting end portion of the preliminary boss portion 92', the part of the preliminary boss portion 92' which did not flow toward the outer shape-forming portion 112 of the piercing die 110 and remains is cut off by the punch-side cutting edge 132 of the piercing punch 130 and the die-side cutting edge 113 of the piercing die 110. As a result, the boss portion 92 is formed from the portion of the preliminary boss portion 92' which has flowed toward the outer shape-forming portion 112 of the piercing die 110, and the remaining part of the preliminary boss portion 92' which did not flow toward the outer shape-forming portion 112 of the piercing die 110 is disposed of as scrap S. This means that the step of causing the preliminary boss portion 92' to flow in sub-step 1 and the step of cutting the preliminary boss portion 92' in sub-step 2 correspond to the boss portion-forming step in the present invention. When the outer periphery of the boss portion 92 is formed, the through-hole 93 is also formed with the straight portion 133 of the piercing punch 130.

After the step of forming the boss portion 92, the press causes the piercing punch 130 and the holding body 120 to move away from the piercing die 110 so that the forming die apparatus 100 is opened or brought into a state where the formed pressed component 90 can be removed from the forming die apparatus 100. Accordingly, the operator removes the pressed component 90 from the opened forming die apparatus 100 to complete the process of forming the pressed component 90.

As can be understood from the above description of operation, in the pressed component-forming method according to the above-described embodiment, the preliminary boss portion 92' projecting and having a bomb-like shape is formed on the blank BL which is the material of the pressed component 90, and the rough hole 95 is then formed in a projecting end portion of the preliminary boss portion 92'. Subsequently, the inner shape-forming portion 131 of the piercing punch 130 is caused to pierce the preliminary boss portion 92' having the rough hole 95 so as to cause part of the preliminary boss portion 92' to flow toward the outer shape-forming portion 112 of the piercing die 110, and then cut off another part of the preliminary boss portion 92' by using the die-side cutting edge 113 and the punch-side cutting edge 132. Namely, in the pressed component-forming method of the present invention, when the boss portion 92 is formed on the blank BL, the bomb-shaped preliminary boss portion 92' is formed, and the rough hole 95 is formed in the projecting end portion of the preliminary boss portion 92'. Thus, according to the pressed component-forming method of the present invention, after the preliminary boss portion 92' with a bomb-like shape which is a simple shape is formed on the blank BL and the rough hole 95 is formed in the projecting end portion of the preliminary boss portion 92', the boss portion 92 is formed by using the piercing punch 130 and the piercing die 110. Therefore, the compressive load required in each step can be reduced. In addition, since the projecting end portion of the preliminary boss portion 92' can be formed so as to have a small wall thickness, it becomes easy to form the rough hole 95 having a diameter smaller than the thickness of the blank BL, and the volume of a part cut off by using the piercing punch 130 and the piercing die 110 can be minimized. As a result, according to the pressed component forming method of the present invention, equipment used for forming the pressed component 90 can be made small and simple, and it becomes possible to form the boss portion 92 with any of a wide variety of shapes, and more specifically with a greater amount of projection and wall thickness than the prior art.

The present invention is not limited to the above-described embodiment, and a variety of modifications can be made without departing from the object of the present invention.

For example, in the above-described embodiment, the holding body 120 and the piercing punch 130 are made to move relative to the piercing die 110. However, since the movements of the piercing die 110, the holding body 120 and the piercing punch 130 are relative movements, these elements may of course be configured such that any one or two of the elements are movable and the remaining element (s) are stationary. For example, the piercing die 110 may be configured to move relative to the holding body 120 and the piercing punch 130.

In the above-described embodiment, the projecting end portion of the preliminary boss portion 92' is formed so as to have a thickness t equal to or less than one tenth of the thickness of the blank BL. However, the thickness t of the projecting end portion of the preliminary boss portion 92' is not limited to that of the above-described embodiment, and any thickness is possible if it is less than or equal to the thickness of the blank BL and it allows formation of the rough hole 95.

In the above-described embodiment, the bomb-shaped portion 222 of the punch 220 for forming the preliminary boss portion 92' and the inner shape-forming portion 131 of the piercing punch 130 for forming the boss portion 92 both have a bomb-like shape with their outer diameters increasing from their tips so as to form a parabolic cross section. However, the bomb-shaped portion 222 of the punch 220 for forming the preliminary boss portion 92' and the inner shape-forming portion 131 of the piercing punch 130 for forming the boss portion 92 may have any shape as long as their outer dimensions increase from their tips. For example, they may have a linearly tapering shape such as a conical shape.

Figure 7:
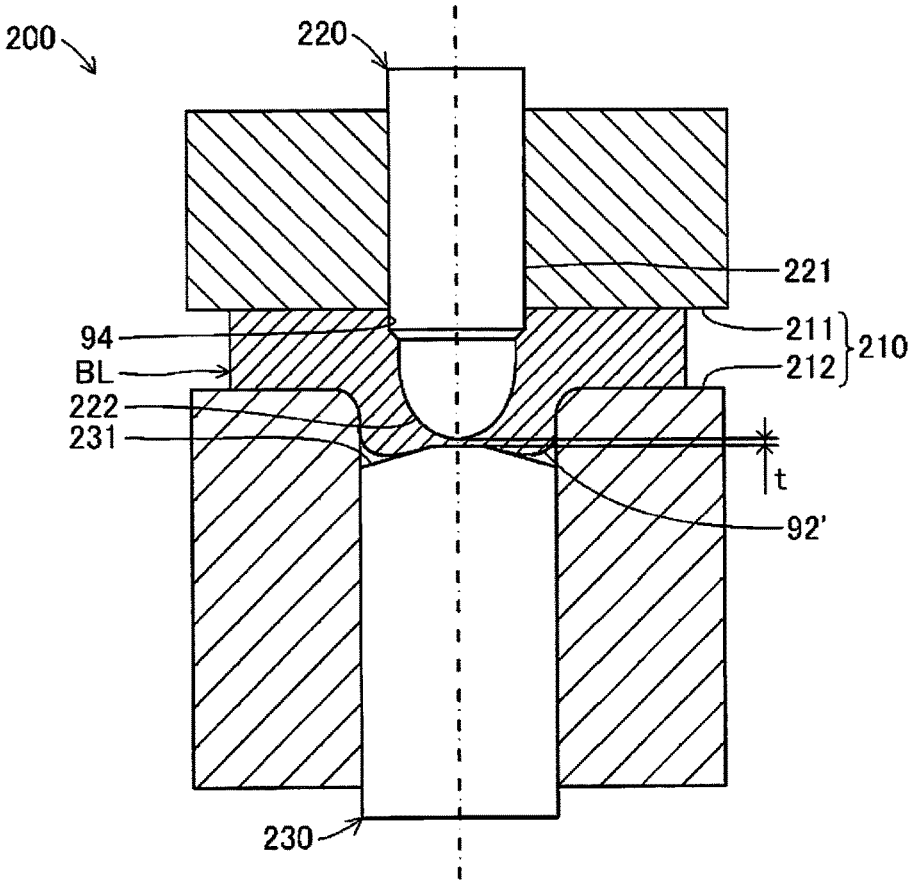
FIG. 7 is a cross-sectional view relating to a modification of the present invention and showing a die apparatus for preliminary forming which is used to form a preliminary boss portion on a blank used in forming a pressed component as well as a process of forming the preliminary boss portion by the die apparatus for preliminary forming.

In the above-described embodiment, the receiving portion 231 of the ejector 230 of the die apparatus for preliminary forming 200 is formed with a flat shape. However, the receiving portion 231 of the ejector 230 is not limited to that of the above-described embodiment, and any shape is possible as long as it can form the preliminary boss portion 92' so as to have a projecting shape. For example, as shown in FIG. 7, the receiving portion 231 of the ejector 230 may be formed with a tapered shape such that the end surface of the receiving portion 231 of the ejector 230 projects at its center. This configuration can ensure that the projecting end portion of the preliminary boss portion 92' has a greater thickness at the circumferential edge thereof. Thus, the amount of scrap S or volume loss can be reduced, whereby the boss portion 92 can have an increased amount of projection and an increased thickness.

In the above-described embodiment, it is assumed that the pressed component 90 is what is referred to as machine part for various types of machinery. However, the pressed component 90 may be a different type of part. This means that the pressed component-forming method according to the present invention may be applied to various pressed metal components configured to have a plate-shaped base portion 91 and a tubular boss portion 92 projecting therefrom. The pressed component 90 is not limited to one having a circular cross section. It may have a non-regular shape, such as one with an elliptic or polygonal cross section (e.g., a triangular or quadrangular cross section). The pressed component 90 may be a component having teeth (such as involute teeth, splines, or serrations) formed on the outer or inner periphery of the boss portion 92. Alternatively, the pressed component

90 may be a component which has teeth and functions as a machine element. In these cases, the shapes of the forming die apparatus 100 and the die apparatus for preliminary forming 200 are naturally determined on the basis of the shape of the pressed component 90.

The material of the blank BL which is formed into the pressed component 90 may be a metal other than a steel plate which is particularly suitable for drawing, such as a plate of SPCC, SPCD, or SPCE. In particular, high-carbon steel or high-tensile steel, which are generally not suitable for drawing and stretch flanging, can also be precisely formed into the pressed component without causing forming failures such as breakage or cracking.

LIST OF REFERENCES

BL: blank
t: thickness of projecting end portion of preliminary boss portion
S: scrap
90: pressed component
91: base portion
92: boss portion
93: through-hole
94: cylindrical portion
95: rough hole
90': preform
92': preliminary boss portion
100: forming die apparatus
110: piercing die
111: receiving portion
112: outer shape-forming portion
113: die-side cutting edge
114: guide hole
120: holding body
121: pressing portion
122: guide hole
130: piercing punch
131: inner shape-forming portion
132: punch-side cutting edge
133: straight portion
200: die apparatus for preliminary forming
210: workpiece chuck
211: movable die
212: stationary die
220: punch
221: columnar portion
222: bomb-shaped portion
230: ejector
231: receiving portion

The invention claimed is:

1. A method for forming a pressed metal component having a plate-shaped base portion and a tubular boss portion extending from the base portion, the method comprising:

preparing a piercing die having a cylindrical outer shape-forming portion having a shape corresponding to an outer shape of the boss portion of the pressed component, and a die-side cutting edge located at a position radially inward from the outer shape-forming portion by an amount corresponding to a thickness of the boss portion;

preparing a piercing punch having a rod-shaped body, a bomb-shaped inner shape-forming portion formed at an end of the rod-shaped body, and a punch-side cutting edge located at a position radially outward from the inner shape-forming portion so as to cooperate with the die-side cutting edge;

pressing a plate-shaped blank using a punch with a bomb-shaped end so as to cause part of the blank to project to form a preliminary boss portion;

forming a rough hole comprising a through-hole in a projecting end portion of the preliminary boss portion; and placing the piercing die so as to face an outer periphery of the preliminary boss portion and the piercing punch so as to face an inner periphery of the preliminary boss portion, and moving the piercing die and the piercing punch relative to each other so as to cause the inner shape-forming portion to pierce the preliminary boss portion to force part of the preliminary boss portion to flow toward the outer shape-forming portion and then cut off another part of the preliminary boss portion by using the die-side cutting edge and the punch-side cutting edge.

2. A method for forming a pressed metal component as claimed in claim 1 wherein forming the preliminary boss portion includes forming the projecting end portion of the preliminary boss portion so as to have a thickness of at most one-tenth the thickness of the blank.

3. A die apparatus for forming a pressed metal component having a plate-shaped base portion and a tubular boss portion extending from the base portion, comprising:

a piercing die having a cylindrical outer shape-forming portion having a shape corresponding to an outer shape of the boss portion of the pressed component, and a die-side cutting edge located at a position radially inward from the outer shape-forming portion by an amount corresponding to a thickness of the boss portion; and a piercing punch having a rod-shaped body, a bomb-shaped inner shape-forming portion formed at an end of the rod-shaped body, and a punch-side cutting edge located at a position radially outward from the inner shape-forming portion so as to cooperate with the die-side cutting edge.

* * * * *